US005887369A

United States Patent [19]

Danielczak

[11] Patent Number: 5,887,369

[45] Date of Patent: Mar. 30, 1999

[54] DECORATIVE WALL DISPLAY ASSEMBLY

[76] Inventor: Gary Raymond Daniel Danielczak, 922 Fox Point Sq., Neenah, Wis. 54956

[21] Appl. No.: 631,664

[22] Filed: Apr. 9, 1996

Related U.S. Application Data

[63] Continuation-in-part of Ser. No. 282,798, Jul. 29, 1994, abandoned, which is a continuation-in-part of Ser. No. 195,345, Feb. 10, 1994, abandoned.

[51] Int. Cl.[6] ..... G09L 13/12

[52] U.S. Cl. ..... 40/428; 40/219; 40/900

[58] Field of Search ..... 40/427, 219, 900

[56] References Cited

U.S. PATENT DOCUMENTS 5,214,539 5/1993 Sorko-Ram ..... 40/219

FOREIGN PATENT DOCUMENTS 1229912 4/1971 United Kingdom ..... 40/219

*Primary Examiner*—Cassandra H. Davis

*Attorney, Agent, or Firm*—Thomas D. Wilhelm; Brian R. Tumm

[57] ABSTRACT

A decorative wall display assembly comprises a frame (14) that has the appearance of a conventional window frame, in combination with a glazing sheet (16), and a conventional mirror (18) mounted toward the rear of the frame, and a space (19) between the glazing sheet (16) and the mirror (18). The overall effect is that the assembly gives the illusory appearance of being a window, and accordingly gives the room in which it is used the appearance of being larger than it actually is, while being flush mounted on the wall as would be a picture or other conventional decorative display assembly.

37 Claims, 3 Drawing Sheets

DECORATIVE WALL DISPLAY ASSEMBLY

This application is a continuation in part of application Ser. No. 08/282,798 filed Jul. 29, 1994 abandoned which is a continuation in part of application Ser. No. 08/195,345 filed Feb. 10, 1994 abandoned.

FIELD OF THE INVENTION

This invention relates to interior decoration assemblies, and especially to decorative wall display assemblies that simulate the appearance of a window, or other apparatus for creating a response like the typical response to a window.

BACKGROUND OF THE INVENTION

Windows serve a variety of functions. Windows provide a view of the outdoor surroundings, outside the building in which the window is used. A window can also give the perception of increasing the size of the room in which it is used.

But windows have the disadvantage that they can only be used on an outer wall of the building. They cannot be used on an interior wall. Windows also have the disadvantage that they are conduits for transmitting a greater amount of heat than is transmitted by a typical insulated exterior wall, whether by conduction, convention, or radiation, thereby increasing winter heat loads and summer air conditioning loads.

On the other hand, a window can provide natural lighting and passive solar heat, and can have beneficial psychological and other effects on people who can view the outdoors through a window.

It is known to attempt to create an illusion of an outdoor atmosphere in a room by placing an assemblage of large color pictures, generally comprising a mural, of summer gardens or winter scenes, namely the current or desired season, of substantially the full height and length of the room. Such assemblages are intended to simulate what might be the view through a large window. The pictures can be made of modular panels assembled close together, to simulate the appearance of an outdoors environment. A typical such modular picture assembly is shown in U.S. Pat. No. 3,447,274 Davidson.

It is also known to use wall decorations that operate as decorative lighting, and which have some of the appearance characteristics of a window. Thus, U.S. Pat. No. 5,265,360 Reiss et al teaches a device having some appearance characteristics of a window. It includes what appears to be a front window sash, and a rearwardly extending enclosure, wherein the enclosure contains decorated panels 50, 56 disposed at angles to the front of the device, to give a three dimensional effect to the appearance of the display inside the device. Lights 72 behind the decorative panels 50, 56 illuminate the decorative panels 50, 56 to provide the desired affect.

U.S. Pat. No. 5,251,392 McManigal teaches a wall mounted device which operates more like a conventional light fixture. A fluorescent light bulb 35 shines light through a translucent diffusion panel assembly, which can include a decorative layer 25. A reflector 36 reflects the rearwardly-directed component of the light toward the diffusion panel assembly.

U.S. Pat. No. 4,139,955 Reiback teaches a decorative lighting device which creates the illusion of depth in the device by using a partially silvered front glazing sheet, which has a transmission factor of 0.10–0.50, in combination with a mirror on the rear wall of the device. Interior light bulbs provide the internally generated light which is necessary for the operation of the display. The front glazing sheet, because of its low transmission factor, reflects at least 50% of the incident light back to the mirror. The mirror then reflects the light back to the front panel. The light follows a path of recurring/multiple reflections, between the front panel and the mirror, for several round trips until that component of the light which has not been transmitted through the front glazing sheet is extinguished.

The above references have none of the window-like characteristics related to a dynamically changing view dependent on the viewer's movements relative to the wall display assembly. Thus, to the extent these references address depth perception, they represent views generated predominantly within the confines of the wall display assembly, as opposed to a conventional window, which represents views generated by light from objects disposed outside the window assembly, where the images seen by the viewer change constantly as the viewer moves about with respect to the window, and wherein the general make-up of the views seen by the viewer is outside the control of the producer of the window.

It is an object of the invention to provide a decorative wall display assembly wherein the views seen by a viewer are generated by light from objects disposed outside the wall display assembly.

It is another object of the invention to have the decorative wall display assembly free from light sources or lamps.

It is another object of the invention to provide a decorative wall display assembly wherein the general make-up of the views seen by the viewer is outside the control of the producer of the wall display assembly.

It is a further object to provide such a decorative wall display assembly that has appearance characteristics of a conventional window in a wall, including a transparent front glazing sheet, a rearwardly disposed mirror reflecting light through the front glazing sheet, and a space between the front glazing sheet and the rearwardly disposed mirror, whereby light images reflected by the mirror are transmitted to and through the glazing sheet without appreciable scattering of the light as such light might be scattered by passing it through a translucent sheet.

It is still another object to provide such a decorative wall display assembly which gives the illusion of being deeper than the actual depth of the assembly as measured between the mirror and the front of the frame, whereby the apparent size of the room in which the display assembly is used is accordingly increased.

It is yet another object to provide such a decorative wall display assembly which provides internal structural support between the glazing sheet and the mirror, across at least one transverse dimension of the assembly.

It is an object of the invention to provide a decorative wall display assembly wherein the mirror comprises an opaque mirror transmitting substantially no light through the rear side thereof.

Still another object is to provide such a decorative wall display assembly wherein the mirror and glazing sheet can readily be removed from the assembly for cleaning or replacement of elements of the assembly.

Yet another object is to provide such a decorative wall display assembly wherein front edges of the mirror and the glazing sheet are separately and individually abutted against a common enclosing frame.

Finally, it is an object to provide such a decorative wall display assembly wherein front edges of the mirror, the glazing sheet, and an optional intervening spacer are all separately and individually abutted against a common enclosing frame, and substantially against each other such that front support of each the mirror, the glazing sheet, and the spacer is generally independent of the front support of the others of the mirror, the glazing sheet and the spacer, and wherein at least partial rear support of the glazing sheet is provided by the spacer and at least partial rear support of the spacer is provided by the mirror.

SUMMARY OF THE DISCLOSURE

Some of the objects are obtained in a decorative wall display assembly comprising a frame having an outer perimeter, a front surface, a rear surface, and an interior opening disposed interiorly of the outer perimeter and between the front surface and the rear surface of the frame; at least one transparent glazing sheet, having a front surface and a rear surface, the at least one glazing sheet extending transversely across the interior opening, and having a light transmission factor of at least 0.70; a mirror, having a front surface and a rear surface, the mirror extending transversely across the interior opening, and being disposed to reflect light toward the at least one transparent glazing sheet; and a space disposed between the mirror and the at least one glazing sheet, the space having a thickness between the mirror and the rear surface of the at least one glazing sheet, the thickness being at least 0.25 inch and no more that about four inches, preferably no more than about two inches, more preferably no more that one inch, still more preferably no more than about 0.5 inch, and most preferably about 0.44 inch, the space comprising transparent light transmission media extending from the mirror to the at least one transparent glazing sheet, whereby light representing images reflected by the mirror can be transmitted to and through the at least one transparent glazing sheet with a light transmission factor, between the mirror and the front surface of the glazing sheet, of at least about 0.70.

In preferred embodiments, the decorative wall display assembly includes a spacer in the space and extending across the thickness, from a position at or propinquant the front surface of the mirror to a position at or propinquant the rear surface of the at least one glazing sheet.

Other objects of the invention are obtained in a decorative wall display assembly comprising a frame having an outer perimeter, a front surface, a rear surface, and an interior opening disposed interiorly of the outer perimeter and between the front surface and the rear surface of the frame; at least one transparent glazing sheet, having a front surface and a rear surface, the at least one glazing sheet extending transversely across the interior opening, and having a light transmission factor of at least 0.70; a mirror, having a front surface and a rear surface, the mirror extending transversely across the interior opening, and being disposed to reflect light toward the at least one transparent glazing sheet; and a spacer disposed between the at least one glazing sheet and the mirror, and thereby defining a space between the mirror and the at least one glazing sheet, the space comprising transparent light transmission media extending from the mirror to the at least one transparent glazing sheet, whereby light representing images reflected by the mirror can be transmitted to and through the at least one transparent glazing sheet with a light transmission factor, between the mirror and the front surface of the glazing sheet, of at least about 0.70.

Still other objects of the invention are obtained in a decorative wall display assembly having the appearance of a window, comprising a frame having an outer perimeter, a front surface, a rear surface, and an interior opening disposed interiorly of the outer perimeter and between the front surface and the rear surface of the frame; at least one transparent glazing sheet, having a front surface and a rear surface, the at least one glazing sheet extending transversely across the interior opening, and having a light transmission factor of at least 0.70; a mirror, having a front surface and a rear surface, the mirror extending transversely across the interior opening, and being disposed to reflect light toward the at least one transparent glazing sheet; a spacer disposed in the interior opening between the at least one transparent glazing sheet and the mirror; and transparent light transmission media extending from the mirror to the at least one transparent glazing sheet, whereby light representing images reflected by the mirror can be transmitted to and through the at least one transparent glazing sheet with a light transmission factor, between the mirror and the front surface of the glazing sheet, of at least about 0.70.

The spacer, where used, preferably defines a space, having a thickness, between the mirror and the at least one transparent glazing sheet, of at least 0.25 inch, and no more than about 4 inches, preferably no more than two inches, more preferably no more than one inch still more preferably no more than 0.50 inch, and most preferably about 0.44 inch.

In any of the above embodiments, it is preferred that the interior opening comprise a first interior receiving perimeter wall disposed toward the front surface of the frame, for receiving the at least one glazing sheet, and a second interior receiving perimeter wall, disposed outwardly and rearwardly of the first interior receiving perimeter wall, and forward of the rear surface of the frame, for receiving the mirror. Accordingly, the edges of the front surface of the mirror are received against a corresponding land surface on the frame, wherein the land surface is disposed either flush with, or preferably rearwardly of, the rear surface of the glazing sheet.

In some embodiments, and especially in those embodiments having the above recited first and second interior receiving perimeter walls, the glazing sheet has a smaller surface area than the mirror.

In some embodiments, the mirror and glazing sheet each have front surfaces, individually and separately abutted against the frame.

In some embodiments, the glazing sheet, the spacer, and the mirror respectively are substantially loosely abutted against each other, each of the glazing sheet, the spacer, and the mirror having a front surface, and a corresponding front edge, the front edges being individually and separately abutted against the frame, whereby the mirror provides at least partial rear support for the glazing sheet and the glazing sheet provides at least partial front support for the mirror.

DETAILED DESCRIPTION OF THE ILLUSTRATED EMBODIMENTS

The overall purpose of displaying the decorative display assembly of the invention is to give the viewer a sense of being in a room which is larger than the room really is, by exposing the viewer to a display assembly that visually resembles a conventional window, where the images seen by the viewer change constantly as the viewer moves about with respect to the assembly. Thus, the overall effect is to give an impression of expansiveness of the room in which the viewer views the decorative wall display assembly of the invention.

Figure 1:
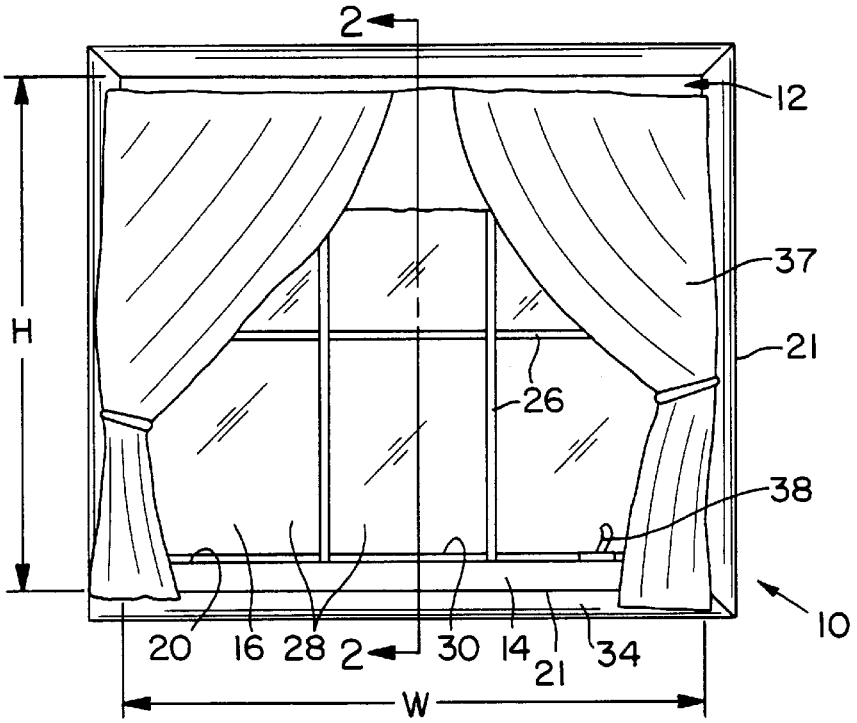
FIG. 1 shows a front elevation view of a decorative wall display assembly of the invention.
Figure 2:
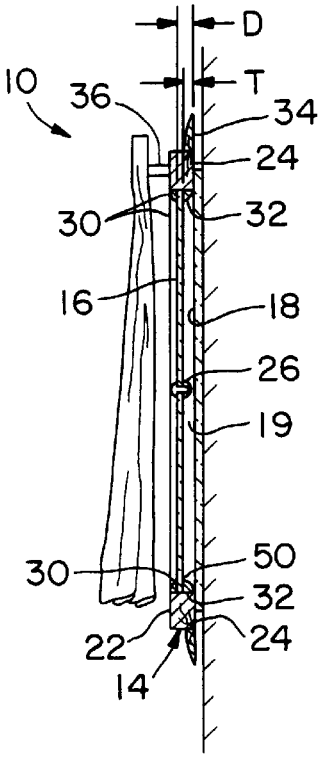
FIG. 2 shows a cross section of the decorative wall display assembly of the invention, taken at 2—2 of FIG. 1.

Referring now to FIGS. 1 and 2, the decorative wall display assembly 10 includes a frame 14 and one or more glazing sheets 16, and a mirror 18 mounted to the rear of the frame. A space 19, including transparent light transmission media, e.g. air, is disposed between the glazing sheet(s) 16 and the mirror 18.

Conventional mirror 18, of course, allows substantially no light to pass through the rear surface. Like any conventional mirror, mirror 18 is opaque with respect to the transmission of light therethrough. Thus opaque mirror 18 transmits substantially no light therethrough. At least 70% of the light incident on the front surface of the mirror is reflected. Most of the remaining light, namely that not reflected to a viewer, is absorbed by the mirror itself or by the glass forming the front of mirror 18 or lost by other well known optical effects. For example, a mirror with a ⅛ inch glass typically reflects about 91% of incident light directed at the mirror in a substantially perpendicular direction. Conventional mirrors with a 3/16 inch glass reflect about 88% of incident light. Conventional mirrors having a ¼ inch thick glass typically reflect about 87% of incident light. The exemplary mirrors described above are manufactured by Gardner Mirror Corp of Wilkesboro, N.C.

Figure 4:
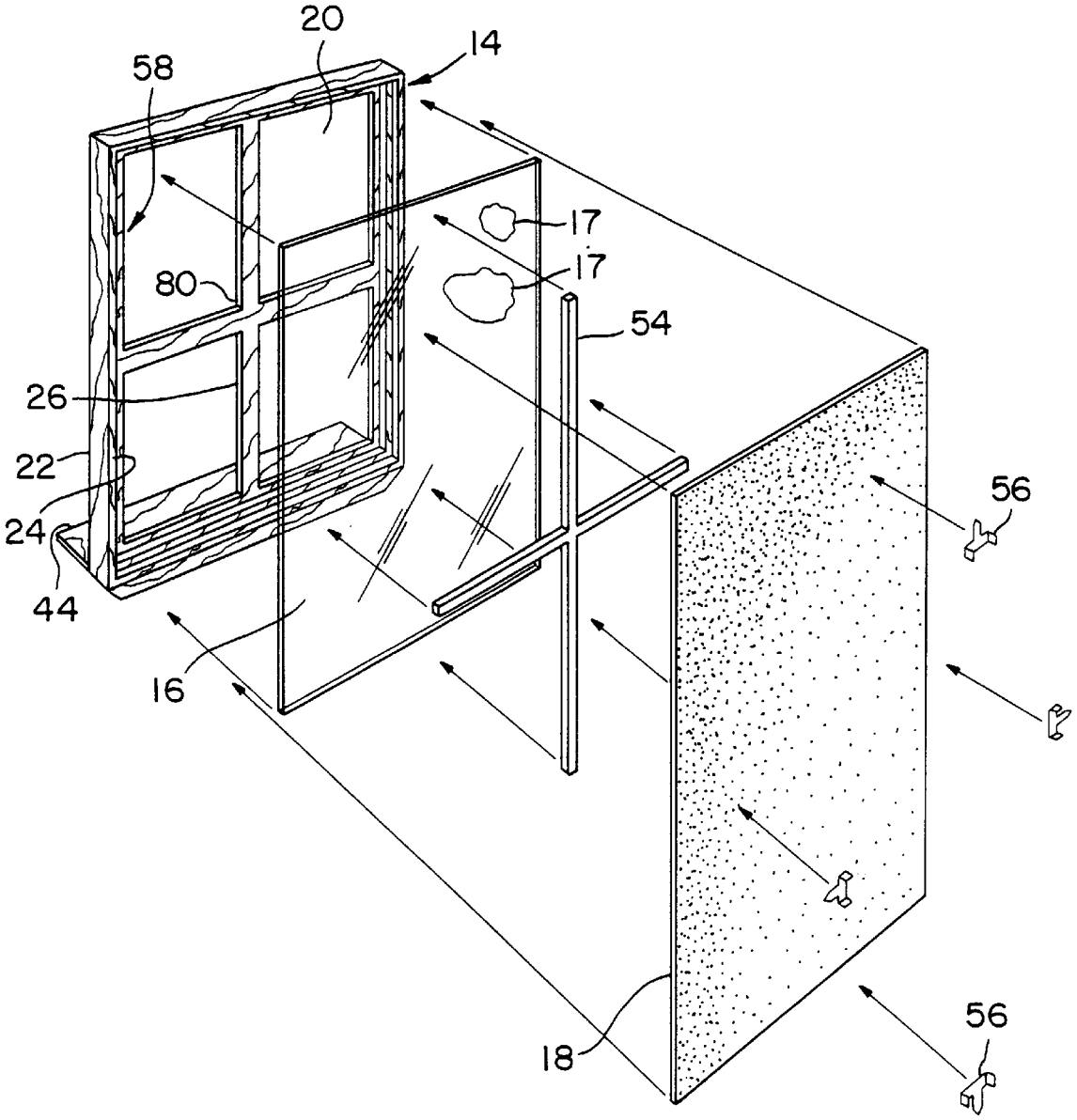
FIG. 4 shows an exploded pictorial view of a third embodiment of the decorative wall display assembly of the invention.
Figure 5:
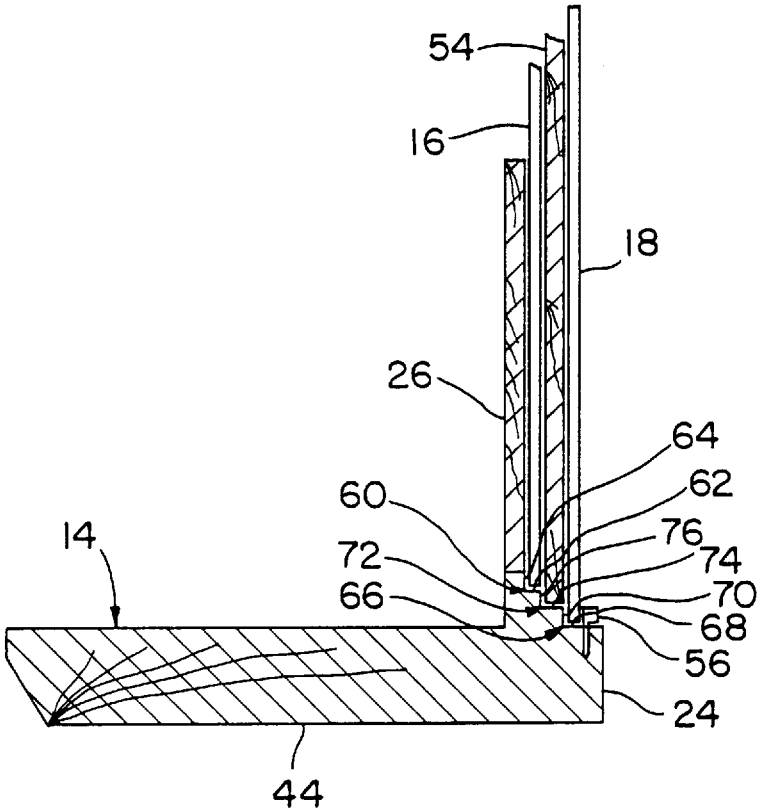
FIG. 5 shows a fragmentary cross-section of an assembly shown in exploded view in FIG. 4.

Further, conventional mirror 18 preferably has a planar surface. The planar surface of the planar mirror is substantially flat across its entire surface. The surface of the planar mirror receives incident light as shown in FIGS. 4 and 5. Thus, the planar mirror 18 does not create a multiplicity of images receding into infinity like a convex curved mirror.

Frame 14 has an outer perimeter 21, defining an included primary interior opening 20, which extends between the front surface 22 of the frame and the rear surface 24 of the frame.

A plurality of dividers 26 divide the primary interior opening 20 into a plurality of secondary interior openings 28. The embodiment shown in the drawings depicts six secondary interior openings 28.

Each secondary interior opening 28 is closed with a transparent glazing sheet 16. Thus, in combination, the several glazing sheets 16 (six as shown) close the primary interior opening 20.

The glazing sheets 16 are preferably made from 0.125 inch or 0.25 inch plate glass, having a transmission factor of about 0.88 to about 0.90. However, any transparent material can be used as the glazing sheets so long as it has a transmission factor of at least about 0.70. For example, certain polymeric sheet materials commonly known as "safety glass" have acceptable transmission factors, and thus are included within the scope of the invention. Forming glazing sheets 16 of plate glass provides the glazing sheets with a planar shape as shown in FIG. 4.

As used herein, the term "transparent" addresses primarily clarity of light transmission as affected by scattering of the light in the transmission medium, and does not address directly the light transmission factor as affected by light absorption. Thus, as used herein a medium of light transmission is "transparent" e.g. between mirror 18 and the front surface of a corresponding glazing sheet 16 if objects as perceived by the viewer, from reflections in the mirror, have substantially the same sharpness of detail as the same objects when viewed directly, both viewings being made under sufficient light to overcome negative affects of light absorption as the light passes through the display assembly. Distortion does not destroy transparency so long as clarity is preserved, it being understood that distortion can affect clarity, as a form of light scattering.

"Transmission factor" is the decimal fraction of perpendicular incident light which is transmitted through the sheet. A transmission factor as low as about 0.70 is acceptable in some embodiments where, for example, one or more of the glazing sheets 16 is a colored transparent sheet, or has colored transparent images placed thereon. However, it is preferred that the transmission factor be at least 0.80, in order that the image be bright, distinct, and easily perceived by a viewer.

The invention contemplates, within the range of its embodiments, that opaque or translucent materials, in addition to dividers 26, or decorative or the like openings, may be used to cover portions of the primary interior opening 20 which is in general closed by the glazing sheets 16. For example, portions of the glazing sheet 16 can be etched in unique designs as illustrated by etched elements 17 in FIG. 4. This etching can be on the outer or inner surface of glazing sheet 16. Any type of scene or picture may be etched on glazing sheet 16. However, there must be enough portions of glazing sheet 16 devoid of etchings so that multiple images created by the glazing sheet 16 and conventional mirror 18 are viewable. In some embodiments, the objectives of the invention are better served where such materials are not used in or on the glazing sheets 16, or otherwise used in the interior opening 20. Any such opaque or translucent material is not considered when determining the transmission factor of the respective glazing sheet 16.

A first set of (exterior) trim pieces 30 extends around the outer perimeter of each of the glazing sheets 16, between the respective glazing sheet and the front surface 22 of the frame, as shown. A second set of (interior) trim pieces 32 extends around the perimeter of the primary interior opening 20, between the respective glazing sheets and the mirror 18.

A third set, of (exterior) trim pieces 34, extends around the frame 14 at its outer perimeter 21, simulating window trim which is commonly used on conventional windows.

The illusion regarding the depth of the assembly 10 is most effective where the second set of trim pieces 32 is finished with a decorative pattern which is used in common with the decorative pattern on the first set of trim pieces 30.

"Decorative pattern" as used herein refers to the combination of color and design which give the image impression regarding the overall appearance of the trim pieces. Thus, a decorative pattern can be a solid color, a patterned color, a series of solid or patterned colors, or the like. Referring to wood which may be used as the structural material for the display assembly, including the trim pieces, the natural grain of the wood can be a decorative pattern as defined herein. In such case, so long as both the first and second sets of trim pieces come from the same general species of wood, or wood having similar grain and color, and the natural grain and color of the wood is shown, or similarly treated to display the natural grain, the natural grain of the wood represents a common color and design, and thus is compatible with the potential for both the first and second sets of trim pieces to have the same decorative pattern.

The important thing about commonality of decorative pattern on the first and second sets of trim pieces is that the overall affect of the second set of trim pieces is that it appears to be an extension of the first set of trim pieces. Thus, the decorative pattern on the second set of trim pieces can indeed differ from the decorative pattern on the first set of trim pieces so long as the pattern on the second set of trim pieces appears to be an extension of the pattern on the first set of trim pieces. Accordingly, where the claims recite the second set of trim pieces "having said decorative pattern," or the like, of the first set of trim pieces, they include the situation where a single decorative pattern, having substantial continuity of design, is defined in combination by considering the decorative pattern elements extant on both the first and second sets of trim pieces.

It is not necessary, however, for the second set of trim pieces to have the same width or thickness dimensions as those of the first set of trim pieces, again so long as there appears to be a continuity of color and/or design. Thus, FIG. 3 shows an embodiment wherein the second set of trim pieces 32 is wider along depth dimension "D" than the first set of trim pieces 30.

Figure 3:
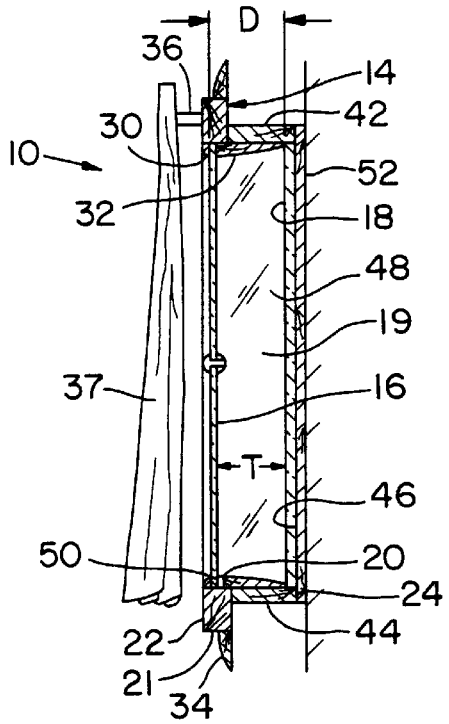
FIG. 3 shows a cross section as in FIG. 2, of a second embodiment of the decorative wall display assembly of the invention.

FIG. 3 shows a second embodiment, similar to the embodiment of FIGS. 1 and 2, but having a rear wall 46 secured against the rear surface 24 of the frame 14, the frame 14 having a top wall 42, a bottom wall 44, a left wall 48, and a corresponding right wall (not shown). Mirror 18 is shown secured against rear wall 46. The top wall, bottom wall, rear wall, and right and left walls all operate together to enclose the space 19 disposed between the glazing sheets 16 and mirror 18. As illustrated, FIG. 3 represents the approximate extreme of thickness "T" of the space 19, at about 4 inches, with the overall height "H" of the frame, as illustrated, being about 30 inches, and the overall width "W" of frame 14 being about 42 inches.

As seen in FIG. 3, the second set of trim pieces 32 is substantially wider along the direction of the depth "D" than the first set of trim pieces 30. However, the continuity of design which, when accompanied by a continuity of color, and thus of decorative pattern, can give the impression of being a single continuous set of trim pieces.

The illusion of depth of the display assembly 10 is also affected by the apparent extension of especially the second set of trim pieces 32 to the mirror 18, as shown in both FIGS. 2 and 3. While it is not absolutely critical that the trim pieces 32 extend to mirror 18, when, and to the extent they do, the illusion of depth can be enhanced.

Still addressing the illusion of depth of the display assembly 10 as served by the first and second sets of trim pieces 30 and 32, FIGS. 2 and 3 show that the glazing sheets 16 are secured in grooves 50 which are defined between the first and second sets of trim pieces 30, 32, and positioned at loci between the front and rear surfaces 22, 24 respectively of the frame 14. Contrary to the structures of conventional windows and conventional mirrors, both sides of the grooves 50 (toward and away from the front surface 22 of frame 14) are visible to the viewer because of the combined effect of the views, into grooves 50, provided by glazing sheets 16 and the mirror 18. Accordingly, the decorative pattern of the first and second sets of trim pieces 30, 32 should be carried into and through groove 50, as a further reinforcement of the illusion of depth of the assembly 10.

Referring to FIGS. 2 and 3, curtain rod hardware 36 preferably is mounted on the top section of frame 14, and holds a decorative fabric 37, such as a curtain or drape. The fabric, when used, serves two functions. First, it enhances the impression that one is looking at a conventional window. Second, to the extent the fabric covers the frame 14, it conceals visual differences, if any, between the frame of the display assembly 10 and the frame of a conventional window, thus preserving part of the impression that one is looking at a conventional window.

Other conventional window hardware, such as a casement crank 38 may be added to the display assembly to further enhance the impression that the wall display assembly 10 is a conventional window.

The combination of frame 14, and its related trim pieces and hardware, can be designed to resemble any conventional window design. Indeed, the appearance of the outer structure surfaces of the display assembly 10 can be made to match exactly the outer appearance of most conventional windows.

The decorative wall display assembly 10 is preferably used by placing it on a wall, such as by hanging it from a nail, a screw, or other such anchor. The display assembly 10 can be used on an outer wall of the building in place of a conventional window, in order to obtain some of the visual attributes of a window without suffering the heat loss expense associated with conventional windows.

Typically, though, the display assembly 10 is used on an interior wall of the building, where a conventional window would in most applications be inappropriate because it could not be used to penetrate to the outside of the building. Thus, the display assembly 10 is typically used to obtain some of the attributes of a conventional window in a location where a conventional window may not be an appropriate choice.

In use, light images from outside the assembly 10 are transmitted through the transparent front glazing sheets 16, through the air or other transmission media transparent to light in space 19, to the mirror 18, where it is reflected by the mirror back through the space 19, and back through front glazing sheets 16, and thus to the person viewing the image. The view/image reflected by the mirror 18, and thus by the display assembly 10 through the operation of mirror 18, changes as the viewer moves in relation to the display assembly. Accordingly, the general make-up of the views seen by the viewer is outside the control of the producer of the display assembly 10.

The thickness "T" of space 19 between the mirror and the front glazing sheets 16 cooperates with the mirror 18 and the glazing sheets 16 in creating a novel composite view and impression, as seen by the viewer, by (i) projecting an illusion of depth greater than the depth "D" which actually exists between the front surface of glazing sheets 16 and mirror 18, and (ii) by casting soft shadowy reflections which, though representing an image transmitted through media transparent to transmission of light, represent neither the view through a regular window (which has no mirror) nor the view reflected by a conventional mirror alone (which has neither the front glazing sheets 16 nor the enclosed space 19 between the front glazing sheets 16 and mirror 18). Thus space 19 is free from other mirrors or glazing sheets located between glazing sheets 16 and mirror 18 as shown in FIGS. 3 and 4.

The illusion of depth of the display assembly 10, and the casting of the soft shadowy reflections are functions of the space 19 and its thickness "T."

The thickness "T" of space 19, between glazing sheets 16 and mirror 18 should be in a range of at least 0.25 inch, up to about 4 inches. At thicknesses less than 0.25 inch, the depth illusion and the shadowy reflections are not sufficiently discernible to provide the benefits preferably ascribed to them herein. At thicknesses greater than 4 inches, the display assembly may protrude from the wall such a distance that its natural projections of illusions of depth of the assembly, and of the enhanced size of the room, are generally less noticeable than is the distance the display assembly extends from the wall into the room. In such circumstances, unless the structure spans an entire wall surface, it looks less like a window or decorative display assembly which tends to enhance apparent size of the room, and more like a piece of functional furniture which en masse tends to reduce the apparent (or perceived) size of the room.

Preferred thicknesses "T," of space 19 are between 0.5 inch and 2 inches. Within this range, the optical/visual impressions of soft shadowy reflections and depth illusions are most apparent, whereby the display assembly appears to be approximately twice as deep as is its actual depth "D." In combination, the corresponding apparent size of the room is desirably enhanced. Also within this range, the display assembly is generally more compact, and easier to handle than the assemblies having greater depth "D."

As the thickness "T" is reduced to less than two inches, to e.g. 1 inch, or 0.5 inch, the divergent relationship between apparent thickness and actual thickness tends to become more pronounced, perhaps because the external thickness dimension of the assembly 10 between the front surface 22 and the rear surface 52, becomes progressively smaller. An optimum thickness dimension "T" for typical assemblies 10 up to about 80 inches in combined height "H" and width "W" is about 7/16 inch, expressed in decimal units as 0.44 inch.

The height "H" and width "W" of the decorative display assemblies 10 of the invention are not limited, except within the dimensions of the wall on which the display assembly 10 is used, and dimensions convenient for construction. Thus, a display assembly 10 can cover an entire wall. In the other extreme, a display assembly 10 can be small such as, for example, a square three or four inches on a side. However, as with a conventional window, the effect of enhancing the apparent size of the room increases with the size of the display assembly 10. Thus, the height and width dimensions of the typical display assembly 10 resemble corresponding dimensions of a typical conventional window, wherein (without limitation) sizes normally range from about 12 inches by 12 inches (1 square foot), to about 5 feet by 8 feet (40 square feet).

FIGS. 4 and 5 show a third embodiment of the invention, similar to the embodiments of FIGS. 1–3, but designed for easier disassembly as for cleaning, or replacement of parts. Included therein is a frame 14, a glazing sheet 16, a spacer 54, a mirror 18, and four retainers 56.

Referring to FIGS. 4 and 5, the primary interior opening 20 includes, and extends rearwardly from, an innermost interior perimeter wall 58, the innermost perimeter wall comprising four secondary interior openings 28 defined by dividers 26. A first interior receiving perimeter wall 60 is disposed outwardly and rearwardly of the innermost interior perimeter wall 58. The first interior receiving perimeter wall 60 includes an outer wall segment 62 and a front wall segment 64, both outer wall segment 62 and front wall segment 64 extending about the perimeter of the first interior receiving perimeter wall 60. As seen in FIG. 5, in the assembly 10, glazing sheet 16 is received within the outer wall segment 62, and is abutted up against the front wall segment 64, with the front outer edges of the glazing sheet extending outwardly from the innermost perimeter wall 58 along front wall segment 64 of the first interior receiving perimeter wall 60.

A second interior receiving perimeter wall 66 is disposed outwardly and rearwardly of the first interior receiving perimeter wall 60. The second interior receiving perimeter wall 66 includes an outer wall segment 68 and a front wall segment 70, both outer wall segment 68 and front wall segment 70 extending about the second interior receiving perimeter wall 66. As seen in FIG. 5, in the assembly 10, mirror 18 is received within the outer wall segment 68, and is abutted up against the front wall segment 70, with the front outer edges of the mirror extending outwardly from the first interior receiving perimeter wall 60 along front wall segment 70.

A third (optional) interior receiving perimeter wall 72 is disposed between the first and second interior receiving perimeter walls 60 and 66. The third interior receiving perimeter wall 72 is disposed outwardly and rearwardly of the first interior receiving perimeter wall 60, and inwardly and frontwardly of the second interior receiving perimeter wall 66. The third interior receiving perimeter wall 72 includes an outer wall segment 74 and a front wall segment 76 extending about the third interior receiving perimeter wall 72. As seen in FIG. 5, in the assembly 10, spacer 54 is received within the outer wall segment 74, and is abutted up against the front wall segment 76, with the front outer edges of the spacer extending outwardly from the first interior receiving perimeter wall 60 along front wall segment 76.

In the embodiment of FIGS. 4 and 5, the dividers 26 are permanent elements of the frame 14, although they need not be. The assembly of FIGS. 4 and 5 is fabricated as follows. With the frame 14 fully assembled as shown, the glazing sheet 16 is inserted into the first interior receiving perimeter wall 60, inside outer wall 62 and abutted against front wall 64.

With the glazing sheet 16 in place, the spacer 54 is placed behind the glazing sheet, with its outer edges inserted into the third interior receiving perimeter wall 72, inside outer wall segment 74 and abutted against front wall segment 76. Preferably, the rear surface of glazing sheet 16 is substantially coplanar with front wall segment 76, or slightly forward thereof, whereby the front surface of the spacer 54 touches, or is propinquant, the rear surface of the glazing sheet.

With the spacer 54 in place, the mirror 18 is placed behind the spacer, with its outer edges inserted into the second interior receiving perimeter wall 66, inside outer wall segment 68 and abutted against front wall segment 70. Preferably, the rear surface of spacer 54 is substantially coplanar with front wall segment 70, or slightly forward thereof, whereby the front surface of the mirror 18 touches, or is propinquant, the rear surface of the spacer.

With all of the glazing sheet, the spacer, and the mirror in place, the retainers 56 are inserted transversely into the frame 14 rearwardly of the mirror, and preferably placing a light forwardly directed pressure on the mirror.

With the retainers 56 in place, the assembly is complete. In such assembly, the spacer, the glazing sheet and the mirror are in close proximity with each other. See FIG. 5.

The front edges of the glazing sheet 16, spacer 54, and mirror 18 are separately and individually abutted against the frame 14, thus receiving primary support, at corresponding front wall segments 64, 76, and 70. The invention does contemplate contact between any one or more of the mirror, the spacer, the glazing sheet, and the dividers 26 within the interior of the primary interior opening 20, such as at crossing 80 of dividers 26. Thus, forwardly directed force placed against the rear surface of mirror 18 is transferred first to frame 14. Little if any movement of the mirror is required to bring the mirror into contact with the spacer and further the spacer into contact with the glazing sheet and the glazing sheet into contact with the dividers 26, whereupon spacer 54, and potentially glazing sheet 16 and dividers 26 provide secondary participation in supporting mirror 18. Similarly, spacer 54, mirror 18, and retainers 56 participate in absorbing forces directed rearwardly against glazing sheet 16.

Thus, at least when the glazing sheet is under a rearwardly directed load, or when the mirror is under a forwardly directed load, the glazing sheet, the spacer, and the mirror are in respective surface-to-surface contact, providing at least partial mutual support to each other.

Spacer 54 can have any configuration transverse to the thickness of the space 19. Thus, rather than having a pair of cross-pieces as shown, the spacer could be confined to the edges of the primary interior opening, taking on much the appearance of a picture frame fitting within the second interior receiving perimeter wall 66. However, the cross-piece configuration is preferred because, with such configuration, the mirror, the spacer, the glazing sheet, and the dividers 26 provide mutual physical support to each other proximate the center of the primary interior opening 20, whereby these elements operate together as a strengthened unit, to attenuate incidences of breakage.

In a fourth embodiment, not illustrated, grooves 50 are provided for both the glazing sheet 16 and the mirror 18 about the top, and left and right sides of the primary interior opening 20 of the frame. The bottom wall 44 of the frame is a single piece as shown in FIG. 5, and is secured into frame 14 by e.g. two screws. In such embodiment, the e.g. two screws can be removed, whereby bottom wall 44 is released. Glazing sheet 16 and mirror 18 can then be removed for e.g. the reasons suggested with respect to FIGS. 4 and 5. The grooving can be readily further configured for removal of spacer 54 if used, also via removal of bottom wall 44.

While conventional mirror 18 is shown as the rear element of the decorative display assembly, a separate rear element comprising cardboard or the like, can be placed behind conventional mirror 18. The separate rear element can comprise a sheet of cardboard substantially the same size as conventional mirror 18. This separate rear element can protect the mirror from damage during shipping, assembly and use.

The decorative display assembly 10 of the invention is not a window, and does not operate like a window, because it does not extend through the wall of the room in which it is used. Accordingly, it does not give a view of the outdoors; neither is it subject to the heat transmission losses characteristic of windows.

The decorative display assembly 10 of the invention is not a conventional mirror, and does not operate like a conventional mirror, because it has visual characteristics of a window, including the at least one transparent glazing sheets 16.

The decorative display assembly 10 of the invention is not a mural because it does not necessarily have a self-contained image within the display assembly. On the other hand, the assembly 10 can include an image on either the mirror 18 or any glazing sheet 16, so long as the mirror retains its reflective function and the glazing sheet retains its transparency and at least minimally acceptable light transmission factor (e.g. 0.70).

Decorative display assembly 10 of the invention does not require an artificial light source. Typical natural incidental room light is more than sufficient to achieve the desired effect. Thus, the decorative display assembly of the invention is free from artificial light sources including lamps which would also increase the cost of display assembly 10.

The decorative display assembly 10 can be mounted at an angle, such that the mirror has a perceived diamond shape. This can be accomplished where the mirror is generally square in shape and the entire assembly is rotated about 45 degrees from normal. This rotation increases the decorative effect and style of the mounted mirror.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A decorative wall display assembly, comprising:

(a) a frame having an outer perimeter, a front surface, a rear surface, and an interior opening disposed interiorly of said outer perimeter and between said front surface and said rear surface of said frame;

(b) at least one transparent glazing sheet, having a front surface and a rear surface, said at least one transparent glazing sheet extending transversely across said interior opening;

(c) a mirror, having a front surface and a rear surface, said mirror extending transversely across said interior opening, said mirror being disposed to reflect light toward said at least one transparent glazing sheet, and said mirror transmitting substantially no light therethrough, said mirror being planar; and (d) a space disposed between said mirror and said at least one glazing sheet, said space having a thickness between said mirror and said rear surface of said at least one glazing sheet, said thickness being at least 0.25 inch and no more than about four inches, said space comprising transparent light transmission media extending from said mirror to said at least one transparent glazing sheet, such that light representing images reflected by said mirror can be transmitted to and through said at least one transparent glazing sheet.

2. A decorative wall display assembly as in claim 1, said thickness of said space being at least 0.25 inch, and no more than about 0.5 inch.

3. A decorative wall display assembly as in claim 1 wherein said decorative wall display assembly has a length of at least 12 inches and a width of at least 12 inches.

4. A decorative wall display assembly as in claim 1, said interior opening comprising a first interior receiving perimeter wall disposed toward said front surface of said frame, for receiving said at least one transparent glazing sheet, and a second interior receiving perimeter wall, disposed outwardly and rearwardly of said first interior receiving perimeter wall, and forward of said rear surface of said frame, for receiving said mirror.

5. A decorative wall display assembly as in claim 1, said mirror and said glazing sheet each having front surfaces, said front surfaces of said mirror and said glazing sheet being individually and separately abutted against said frame.

6. A decorative wall display assembly as in claim 1, said assembly being free from internal light sources.

7. A decorative wall display assembly as in claim 1, at least a portion of said glazing sheet being etched.

8. A decorative wall display assembly as in claim 1, said thickness of said space being at least 0.25 inch, and no more than about two inches.

9. A decorative wall display assembly as in claim 1, said thickness of said space being at least 0.25 inch, and no more than about one inch.

10. A decorative wall display assembly comprising:

(a) a frame having an outer perimeter, a front surface, a rear surface, and an interior opening disposed interiorly of said outer Perimeter and between said front surface and said rear surface of said frame;

(b) at least one transparent glazing sheet, having a front surface and a rear surface, said at least one transparent glazing sheet extending transversely across said interior opening, and having a light transmission factor of at least 0.70;

(c) a mirror, having a front surface and a rear surface, said mirror extending transversely across said interior opening, said mirror being disposed to reflect light toward said at least one transparent glazing sheet, and said mirror transmitting substantially no light therethrough;

(d) a space disposed between said mirror and said at least one glazing sheet, said space having a thickness between said mirror and said rear surface of said at least one glazing sheet, said thickness being at least 0.25 inch and no more than about one inch, said space comprising transparent light transmission media extending from said mirror to said at least one transparent glazing sheet; and (e) a spacer in said space and extending across said thickness, from a position at said front surface of said mirror to a position at said rear surface of said at least one glazing sheets, such that light representing images reflected by said mirror can be transmitted to and through said at least one transparent glazing sheet.

11. A decorative wall display assembly as in claim 10, said glazing sheet, said spacer, and said mirror respectively being substantially loosely abutted against each other, said glazing sheet, said spacer, and said mirror each having a front surface, and corresponding front edges, said front edges of said glazing sheet, said spacer, and said mirror being individually and separately abutted against said frame, whereby said mirror provides at least partial rear support for said glazing sheet and said glazing sheet provides at least partial front support for said mirror.

12. A decorative wall display assembly having the appearance of a window, comprising:

(a) a window frame having an outer perimeter, a front surface, a rear surface, and an interior opening disposed interiorly of said outer perimeter and between said front surface and said rear surface of said frame;

(b) at least one transparent glazing sheet, having a front surface and a rear surface, said at least one transparent glazing sheet extending transversely across said interior opening;

(c) a mirror, having a front surface and a rear surface, said mirror extending across said interior opening, said mirror being disposed to reflect light toward said at least one transparent glazing sheet, said mirror transmitting substantially no light therethrough, said mirror being planar; and (d) a spacer disposed in said interior opening between said at least one transparent glazing sheet and said mirror, said spacer loosely abutting said glazing sheet and said mirror;

such that light representing images reflected by said mirror can be transmitted to and through said at least one transparent glazing sheet.

13. A decorative wall display assembly as in claim 12, said spacer defining a space, having a thickness, between said mirror and said at least one transparent glazing sheet, said thickness of said space being at least 0.25 inch, and no more than about four inches.

14. A decorative wall display assembly as in claim 12, said interior opening comprising a first interior receiving perimeter wall disposed toward said front surface of said frame, for receiving said at least one transparent glazing sheet, and a second interior receiving perimeter wall, disposed outwardly and rearwardly of said first interior receiving perimeter wall, and forward of said rear surface of said frame, for receiving said mirror.

15. A decorative wall display assembly as in claim 12 wherein said glazing sheet has a smaller surface area than said mirror.

16. A decorative wall display assembly as in claim 12, said mirror and said glazing sheet each having front surfaces, said front surfaces of said mirror and said glazing sheet being individually and separately abutted against said frame.

17. A decorative wall display assembly as in claim 12, said glazing sheet, said spacer, and said mirror each having a front surface, and corresponding front edges, said front edges of said glazing sheet, said spacer, and said mirror being individually and separately abutted against said frame, whereby said mirror provides at least partial rear support for said glazing sheet and said glazing sheet provides at least partial front support for said mirror.

18. A decorative wall display assembly as in claim 12, said assembly being free from internal light sources.

19. A decorative wall display assembly, comprising:

(a) a frame having an outer perimeter, a front surface, a rear surface, and an interior opening disposed interiorly of said outer perimeter and between said front surface and said rear surface of said frame;

(b) at least one transparent glazing sheet, having a front surface and a rear surface, said at least one transparent glazing sheet extending transversely across said interior opening;

(c) a mirror, having a front surface and a rear surface, said mirror extending across said interior opening, said mirror being disposed to reflect light toward said at least one transparent glazing sheet, said mirror transmitting substantially no light therethrough, said mirror being planar; and (d) a space between said at least one transparent glazing sheet and said mirror, said space having a thickness between said mirror and said rear surface of said at least one glazing sheet;

such that light representing images reflected by said mirror can be transmitted to and through said at least one transparent glazing sheet.

20. A decorative wall display assembly as in claim 19, said thickness of said space being at least 0.25 inch and no more than about four inches, said space comprising transparent light transmission media extending from said mirror to said at least one transparent glazing sheet.

21. A decorative wall display assembly as in claim 19, said thickness of said space being at least 0.25 inch, and no more than about two inches.

22. A decorative wall display assembly as in claim 19, said thickness of said space being at least 0.25 inch, and no more than about one inch.

23. A decorative wall display assembly as in claim 19, said thickness of said space being at least 0.25 inch, and no more than about 0.5 inch.

24. A decorative wall display assembly as in claim 19 wherein said glazing sheet has a smaller surface area than said mirror.

25. A decorative wall display assembly as in claim 19, and including a spacer in said space and extending across said thickness, from a position at said front surface of said mirror to a position at said rear surface of said at least one glazing sheet.

26. A decorative wall display assembly as in claim 25, said glazing sheet, said spacer, and said mirror respectively being substantially loosely abutted against each other, said glazing sheet, said spacer, and said mirror each having a front surface, and corresponding front edges, said front edges of said glazing sheet, said spacer, and said mirror being individually and separately abutted against said frame, whereby said mirror provides at least partial rear support for said glazing sheet and said glazing sheet provides at least partial front support for said mirror.

27. A decorative wall display assembly as in claim 19, said interior opening comprising a first interior receiving perimeter wall disposed toward said front surface of said frame, for receiving said at least one transparent glazing sheet, and a second interior receiving perimeter wall, disposed outwardly and rearwardly of said first interior receiving perimeter wall, and forward of said rear surface of said frame, for receiving said mirror.

28. A decorative wall display assembly as in claim 19, said mirror and said glazing sheet each having front surfaces, said front surfaces of said mirror and said glazing sheet being individually and separately abutted against said frame.

29. A decorative wall display assembly as in claim 19, said assembly being free from internal light sources.

30. A decorative wall display assembly as in claim 19, at least a portion of said glazing sheet being etched.

31. A decorative wall display assembly as in claim 19, said mirror being opaque.

32. A decorative wall display assembly, comprising:

(a) a frame having an outer perimeter, a front surface, a rear surface, and an interior opening disposed interiorly of said outer perimeter and between said front surface and said rear surface of said frame;

(b) at least one transparent planar glazing sheet, having a front surface and a rear surface, said at least one transparent glazing sheet extending transversely across said interior opening;

(c) a mirror, having a front surface and a rear surface, said mirror extending transversely across said interior opening, said mirror being disposed to reflect light toward said at least one transparent glazing sheet, and said mirror transmitting substantially no light therethrough, said mirror being planar; and (d) a space disposed between said mirror and said at least one glazing sheet, said space having a thickness, said space comprising transparent light transmission media extending from said mirror to said at least one transparent glazing sheet, said space being free from mirrors or glazing sheets, such that light representing images reflected by said mirror can be transmitted to and through said at least one transparent glazing sheet.

33. A decorative wall display assembly as in claim 32, said assembly being free from internal light sources.

34. A decorative wall display assembly as in claim 32, at least a portion of said glazing sheet being etched.

35. A decorative wall display assembly, comprising:

(a) a frame having an outer perimeter, a front surface, a rear surface, and an interior opening disposed interiorly of said outer perimeter and between said front surface and said rear surface of said frame;

(b) at least one transparent planar glazing sheet, having a front surface and a rear surface, said at least one transparent glazing sheet extending transversely across said interior opening;

(c) a mirror, having a front surface and a rear surface, said mirror extending transversely across said interior opening, said mirror being disposed to reflect light toward said at least one transparent glazing sheet, said mirror being planar; and (d) a space disposed between said mirror and said at least one glazing sheet, said space having a thickness, said space comprising transparent light transmission media extending from said mirror to said at least one transparent glazing sheet, said display assembly being free from internal light sources, such that light representing images reflected by said mirror can be transmitted to and through said at least one transparent glazing sheet.

36. A decorative wall display assembly as in claim 35, said thickness of said space being at least 0.25 inch and no more than about four inches.

37. A decorative wall display assembly having the appearance of a window, comprising:

(a) a window frame having an outer perimeter, a front surface, a rear surface, and an interior opening disposed interiorly of said outer perimeter and between said front surface and said rear surface of said frame;

(b) at least one transparent glazing sheet, having a front surface and a rear surface, said at least one transparent glazing sheet extending transversely across said interior opening, at least a portion of said glazing sheet being etched;

(c) a mirror, having a front surface and a rear surface, said mirror extending across said interior opening, said mirror being disposed to reflect light toward said at least one transparent glazing sheet, said mirror transmitting substantially no light therethrough; and (d) a spacer disposed in said interior opening between said at least one transparent glazing sheet and said mirror, said spacer loosely abutting said glazing sheet and said mirror;

such that light representing images reflected by said mirror can be transmitted to and through said at least one transparent glazing sheet.

* * * * *